US010899144B2

(12) United States Patent
Gaab et al.

(10) Patent No.: US 10,899,144 B2
(45) Date of Patent: Jan. 26, 2021

(54) PRINTING PRESS HAVING AN INFRARED DRYER UNIT

(71) Applicant: Heraeus Noblelight GmbH, Hanau (DE)

(72) Inventors: Lotta Gaab, Darmstadt (DE); Larisa Von Riewel, Bergisch Gladbach (DE)

(73) Assignee: HERAEUS NOBLELIGHT GMBH, Hanau (DE)

( * ) Notice: Subject to any disclaimer, the term of this patent is extended or adjusted under 35 U.S.C. 154(b) by 0 days.

(21) Appl. No.: 16/479,982

(22) PCT Filed: Feb. 19, 2018

(86) PCT No.: PCT/EP2018/053972
§ 371 (c)(1),
(2) Date: Jul. 23, 2019

(87) PCT Pub. No.: WO2018/188839
PCT Pub. Date: Oct. 18, 2018

(65) Prior Publication Data

US 2020/0023653 A1 Jan. 23, 2020

(30) Foreign Application Priority Data

Apr. 12, 2017 (DE) ..... 10 2017 107 920

(51) Int. Cl.
*B41J 11/00* (2006.01)

(52) U.S. Cl.
CPC ..... *B41J 11/002* (2013.01)

(58) Field of Classification Search
CPC ..... B41J 11/002
See application file for complete search history.

(56) References Cited

U.S. PATENT DOCUMENTS 6,118,109 A 9/2000 Sako
6,244,700 B1 * 6/2001 Kimura ..... B41J 11/002 347/102

(Continued)

FOREIGN PATENT DOCUMENTS

CN 106032090 10/2016
DE 69828212 T2 12/2005

(Continued)

OTHER PUBLICATIONS

German Office Action dated Mar. 19, 2019 in corresponding German Patent Application No. 102017107920.3.

(Continued)

*Primary Examiner* — Jason S Uhlenhake
(74) *Attorney, Agent, or Firm* — Stradley Ronon Stevens and Young, LLP

(57) ABSTRACT

Printing machines are fitted with a printer assembly for application of solvent-containing printing ink onto a printing substrate. A transport device transports the printing substrate from the printer assembly to a dryer unit that has at least one infrared radiator for drying the printing substrate. The dryer unit is improved in terms of homogeneity and rapidity of the drying of solvent-containing printing ink, and in that no active cooling of the infrared radiator is required. The infrared radiator is a planar heating element made of a dielectric, emits infrared radiation when heated, and comprises a heating surface that faces the printing substrate to be dried. The infrared radiator has a contacting surface, onto which a printed conductor of a heating conductor made of an electrically conductive precious metal-containing resistor material is applied, that is connected to an adjustable current source by an electrical contact.

16 Claims, 3 Drawing Sheets

(56) References Cited

U.S. PATENT DOCUMENTS

| | | | | |
|---|---|---|---|---|
| 9,522,532 | B2 | 12/2016 | Yoneyama et al. | |
| 2003/0177927 | A1 | 9/2003 | Dziedzic et al. | |
| 2016/0082726 | A1* | 3/2016 | Yoneyama ..... | C09D 11/106 347/9 |
| 2018/0332665 | A1 | 11/2018 | Gaab et al. | |

FOREIGN PATENT DOCUMENTS

| | | |
|---|---|---|
| DE | 102006026652 | 1/2007 |
| DE | 102005046230 | 3/2007 |
| DE | 102015119763 | 5/2017 |
| EP | 0495770 | 7/1995 |
| JP | 2011143626 | 7/2011 |

OTHER PUBLICATIONS

German Office Action dated Nov. 21, 2017 in corresponding German Patent Application No. 102017107920.3.

International Search Report and Written Opinion dated May 14, 2018 for corresponding International Patent Application No. PCT/EP2018/053972.

Manara et al., "Determining the Transmittance and Emittance of Transparent and Semitransparent Materials at Elevated Temperatures", 5th European Thermal-Sciences Conference, The Netherlands, 2008.

Korean Office Action dated Aug. 14, 2020 in corresponding Korean Patent Application No. 10-2019-7030021.

Japanese Office Action dated Aug. 27, 2020 in corresponding Japanese Patent Application No. 2019-541396.

Chinese Office Action dated Oct. 23, 2020 in corresponding Chinese Patent Application No. 201880024331.5.

* cited by examiner

PRINTING PRESS HAVING AN INFRARED DRYER UNIT

RELATED APPLICATIONS

This application is a U.S. national phase application of International Patent Application No. PCT/EP2018/053972 filed on Feb. 19, 2018 and published as International Publication No. WO 2018/188839 on Oct. 18, 2018. This application claims the benefit of priority to Patent Application No. 10 2017 107 920.3 filed in Germany on Apr. 12, 2017, the contents of which are incorporated in this application by reference.

FIELD OF THE INVENTION

The invention relates generally to a printing machine with a printer assembly for application of solvent-containing printing ink onto a printing substrate and, more specifically, to a transport device for transporting the printing substrate from the printer assembly to a dryer unit that comprises at least one infrared radiator for drying of the printing substrate.

BACKGROUND OF THE INVENTION

Offset printing machines, lithographic printing machines, rotary printing machines or flexo printing machines are used to print printing inks onto sheet-like or web-like printing substrates made of paper, cardboard, film or carton. Oils, resins and binding agents are typical ingredients of printing inks. Referring to UV-curable printing inks, the curing and adhesion on the printing substrate are based on polymerization that is initiated through photoinitiation using UV light. Solvent-containing and especially water-containing printing inks and lacquers require a drying process that can be based both on physical and chemical drying processes. Physical drying processes comprise the evaporation of solvents and the diffusion thereof into the printing substrate, which is also referred to as "sweeping away." Chemical drying is understood to be the oxidation and/or polymerization of the ingredients of printing inks.

There are overlaps between physical and chemical drying processes. For example, the sweeping away of the solvents can effect an approximation of monomeric resin molecules such that these may polymerize more easily, if applicable. Accordingly, drying devices for drying of the printed printing substrate are used to remove solvent and/or to initiate cross-linking reactions.

DE 102005046230 A1 describes a rotary printing machine with a printing mechanism for the printing of printing ink onto a printing sheet, and a lacquering device for application of a lacquer to the printed printing sheet. In the area of the sheet path, IR radiation-emitting drying facilities in the form of infrared radiators that can also be realized in the form of carbon radiators are arranged downstream from the printing mechanism and the lacquering device.

Infrared radiators of this type have a heating filament made of carbon or tungsten in the form of a coil or web enclosed in an inert gas-filled radiator tube, which is usually fabricated from quartz glass. The heating filaments are connected to electrical connectors that are introduced via one end and/or both ends of the radiator tube.

The heating filaments themselves have a very low thermal mass and, accordingly, a rapid reaction time in the range of 1 to 2 seconds. But it may take several minutes for the entire IR dryer system consisting of quartz tube, filament, electrical connectors, and a reflector to attain thermal equilibrium.

Because the printing substrate runs with a web speed of 3 to 5 m/s in modern rotary printing machines and this speed is established even at the onset, up to 1,500 m of printing substrate may get lost until thermal equilibrium is attained. Alternating between individual printing processes, these losses are incurred with each new printing process.

The higher the electrical power of the quartz tube radiators, the faster they reach the temperature of the IR dryer system. But increasing the power not only increases the amount of energy emitted by the infrared radiator, which may lead to overheating of the printing substrate, it also changes the main wavelength of the emitted radiation shifting it in the direction of the short-wave range of the spectrum.

Referring to water-based printing inks, it is desirable to have the main emission wavelength of the infrared radiator match the absorption characteristics of water, i.e., be at approximately 2.75 μm. Previous commercial infrared radiators therefore comprise one of two alternatives. They may have a matched emission spectrum. But then they have low electrical power and require, for sufficiently high emission power, a comparably large emission surface and accordingly a high heat capacity, which, in turn, causes comparably long heating and cooling times of the infrared radiator and therefore makes the dryer unit slow to react. Alternatively, the infrared radiators have high electrical power and do not react slowly. But then their emission spectrum is not optimally adapted to the absorption characteristics of water.

Often, multiple infrared radiator tubes situated next to each other form a panel radiator. In order to attain a homogeneous emission on the printing substrate, the distance between the panel radiator and the printing substrate should be at least 1.5-fold the center-to-center distance between the individual radiator tubes provided the longitudinal axes of the radiator tubes are aligned in the transport direction of the printing substrate. This minimum distance between panel radiator and printing substrate is comparably large and leads to a low effective radiation intensity at the printing substrate level, which increases the reaction time within which the requisite radiation power is applied to the printing substrate.

However, a rapid reaction time is required especially for multi-color printing before the printing substrate either has the next color printed on it or is processed by a lacquer application or is reversed in the printing machine for the purpose of printing on the rear side. This is because of the relatively short period of time in which the printing substrate is situated between the printing mechanisms, and the requisite radiation power needs to act on the printing substrate without the printed image being damaged by overheating.

Moreover, both short- and medium-wave infrared radiators with an emission wavelength in the range of approximately 1,000-2,750 nm need to be cooled actively, especially in confined assembly spaces as are typical of printing machines, in order to protect them from overheating. A flow of cooling air that is blown directly at the infrared radiators is often generated for this purpose. However, it has been evident that cooling air flowing past the infrared radiator interacts with warm process air, which, inter alia, serves for dissipating humidity, and thus the temperature on the printing substrate is changed and the dissipation of humidity is reduced.

The invention is therefore based on the object to provide a printing machine with a dryer device that is improved in terms of the homogeneity and rapidity of the drying of solvent-containing and, in particular, water-based printing ink, and in which the dryer unit works without active cooling of the infrared radiator.

SUMMARY OF THE INVENTION

This object is met according to the invention based on an infrared radiator of the type specified above in that the infrared radiator is designed as a planar or two-dimensional heating element made of a heating element material that is dielectric and emits infrared radiation when heated, and comprises a heating surface that faces the printing substrate to be dried and a contacting surface onto which a printed conductor of a heating conductor made of an electrically conductive precious metal-containing resistor material is applied that is connected to an adjustable current source by an electrical contact.

The infrared dryer unit of the printing machine according to the invention comprises at least one heating element that comprises a heating surface that faces the printing substrate to be dried. The heating surface emits infrared radiation in the direction of the printing substrate. It is designed to be planar and, in the simplest case, to be level or flat, but can just as well comprise a structure and a planar geometrical shape that deviate from planarity. The planarity of the heating surface results in an accordingly planar radiation field and allows for a short distance to be set between the printing substrate and the heating element. This design contributes to the homogeneity and rapidity of the drying process; as shall be explained in more detail below.

The heating element consists of a dielectric material, at least in part. The material is electrically non-conductive and can therefore not be readily heated by a direct flow of current, but can be heated by heat conduction via the printed conductor of the heating conductor. Accordingly, the printed conductor is used directly for heating of the heating element. Due to being heated, the heating element material emits infrared radiation in the medium-wave wavelength range that corresponds, as closely as possible, to the absorption characteristics of water.

The heating element is the actual infrared radiation-emitting element. It can be designed to be multi-layered, but is preferred to be fabricated entirely from the dielectric heating element material. It is essential that the surface regions occupied by the printed conductor consist of electrically insulating material in order to reliably prevent flashovers and short-circuiting between neighboring printed conductor sections.

The contacting of the heating element to the heating conductor takes place, for example, through a contacting surface that is situated opposite from the heating surface. The contacting surface is in direct contact or indirect contact—via an electrically-insulating and heat-conducting intermediate layer—with the printed conductor made of a resistor material.

The resistor material is infrared-enabled in that it is temperature-resistant up to at least 1,000° C., ideally in an oxidative environment as well, in that it is electrically-conductive, and in that its electrical conductivity does not change significantly with temperature or in that the change of resistance is known. These conditions are met specifically:

(1) by a precious metal-containing resistor material. The resistor material that is preferred in this context consists of at least 50 atom-%, preferably of at least 95 atom-%, of platinum group elements. The platinum group comprises the following precious metals: Ru, Rh, Pd, Os, Ir, Pt. These metals are present as pure elements or as an alloy including the elements or including one or more other metals, in particular Au, Ag.

(2) by a resistor material made of high temperature-resistant steel, tantalum, a ferritic FeCrAl alloy, an austenitic CrFeNi alloy, silicon carbide, molybdenum silicide or a molybdenum-based alloy. These materials, specifically silicon carbide (SiC), molybdenum silicide ($MoSi_2$), tantalum (Ta), high temperature-resistant steel or a ferritic FeCrAl alloy such as Kanthal® (Kanthal® is a registered trademark of Sandvik Intellectual Property AB, 811 81 Sandviken, SE), are resistant to oxidation in air and are less expensive than platinum group metals.

The printed conductor is preferably generated in the form of a thick film layer, for example made of resistor paste, by screen printing or from metal-containing ink by inkjet printing and is subsequently burned in at high temperature. The printed conductor extends, for example, in a spiral-shaped or meander-shaped line pattern. The absorption capacity of the heating element material is high which enables homogeneous emission even if the printed conductor occupation density of the heating surface is comparably low. A low occupation density is characterized in that the minimum distance between neighboring sections of the printed conductor is 1 mm or more, preferably 2 mm or more. The distance between sections of the printed conductor being large prevents flashover, which can occur, in particular, upon operation at high voltages in a vacuum. The printed conductor can be coated, at least in part, by a cover layer made of an electrically insulating and/or optically diffracting material. The cover layer serves as a reflector and/or for mechanical protection and stabilization of the printed conductor.

The printed conductor of the heating conductor is connected to an electrical contact by which it can be connected to an electrical circuit. Preferably, the electrical contact can be connected to the electrical circuit detachably, for example through a plug, screw or clamp connection.

The planar shape of the heating element and the infrared emission enable a homogeneous planar emission of infrared radiation and, associated with it, a reduction of the distance between the printing substrate and the heating element. By this configuration, it is feasible to provide a higher radiation power per unit area and to generate a homogeneous emission and a uniform temperature field even for thin heating element walls and/or at a comparably low printed conductor occupation density.

Due to the uniform emission and high emissivity, the distance between the printing substrate and the heating element can be kept small, which increases the irradiation intensity and the efficiency accordingly. The distance is preferred to be less than 15 mm.

The short distance allows for high power densities in excess of 100 $kW/m^2$ and even in excess of 200 $kW/m^2$ on the printing substrate and leads to a reduction of the paper wastage in modern high-performance printing machines. Preferably, the heating element can attain a power density in excess of 180 $kW/m^2$, preferably a power density in the range of 180 $kW/m^2$ to 265 $kW/m^2$. In this context, the power per unit area is defined as the connected electrical load of the printed conductor relative to the base body surface occupied by the printed conductor.

The forced flow of warm process air regulates the temperature on the printing substrate and dissipates humidity. The dissipation of humidity depends on the absorption capacity of the process air (determined mainly by the temperature) and the process air's effect on the printing substrate (determined mainly by flow properties). Thin heating elements have a low heat capacity and facilitate rapid temperature changes. Active cooling by cooling air flowing past the infrared radiator is therefore not required. Accordingly, using the printing machine according to the invention, interactions with the warm process air that would affect the temperature and flow properties thereof and reduce the temperature of the printing substrate and of the warm process air and would thus slow down the dissipation of humidity are prevented.

With a view to the shortest possible reaction time, the printing machine according to the invention is therefore preferred to be fitted with a plate-shaped heating element with a plate thickness of less than 10 mm. The transport device defines a maximum format width for transport of the printing substrate, whereby, in a preferred case, for irradiation across the entire format width, the heating element consists of multiple heating element portions that can be electrically controlled independent of each other.

In this context, the heating element portions span the maximum possible format width of the printing machine. They are placed against each other, for example, without clearance. Because they can be switched and controlled separately of each other, individual heating elements can be added to or subtracted from the circuit according to need. Any heat loss due to heat conduction from the activated heating element(s) to the non-activated heating element(s) can be reduced by additional thermal separation.

It has proven to be advantageous for the heating element material to comprise an amorphous matrix component as well as an additional component in the form of a semiconductor material.

The amorphous material, such as quartz glass, can easily be made to have the suitable geometrical shape for the application at hand, i.e., for example in the form of planar, curved or corrugated plates. The additional component embedded therein forms its own amorphous or crystalline phase of semiconductor material, such as silicon. The energy difference between the valence band and the conduction band (bandgap energy) decreases with increasing temperature. However, if the activation energy is sufficiently high, electrons can be elevated from the valence band to the conduction band, which is associated with a clear increase in the absorption coefficient. The heat-activated occupation of the conduction band leads to the semiconductor material being transparent to a certain degree at room temperature for certain wavelengths (such as from approximately 1,000 nm) and turning opaque at high temperatures. Accordingly, the absorption and the emissivity can increase with increasing temperature of the heating element material. This effect depends, inter alia, on the structure (amorphous/crystalline) and doping of the semiconductor. For example, pure silicon shows a notable increase in emission from approximately 600° C., reaching saturation at approximately 1,000° C.

If the semiconductor material is heated sufficiently, it can assume an energy-rich excited state, in which it emits infrared radiation at high power density. In this state, the semi-conducting additional component determines the optical and thermal properties of the heating element significantly; more specifically, it effects absorption in the infrared range of the spectrum (meaning in the wavelength range between 780 nm and 1 mm) and, in particular, absorption in the wavelength range around 2,750 nm. A heating element of this type allows power densities in excess of 180 kW/m$^2$, preferably power densities in the range of 180 kW/m$^2$ to 265 kW/m$^2$, to be attained.

Accordingly, a heating element material of this type has an excitation temperature, which needs to be reached at least in order to attain thermal excitation of the material and thus high emission of radiation. The additional component then leads to the heating element material emitting infrared radiation. The emissivity $\varepsilon_\lambda$ can be calculated as follows if the spectral hemispherical reflectance $R_{gh}$ and the transmittance $T_{gh}$ are known:

$$\varepsilon_\lambda = 1 - R_{gh} - T_{gh} \quad (1)$$

In this context, the "emissivity" shall be understood to be the "spectral normal degree of emission." Emissivity is determined by a measuring principle that is known by the name of "Black-Body Boundary Conditions" (BBC) and is published in "DETERMINING THE TRANSMITTANCE AND EMITTANCE OF TRANSPARENT AND SEMI-TRANSPARENT MATERIALS AT ELEVATED TEMPERATURES," J. Manara, M. Keller, D. Kraus, and M. Arduini-Schuster; 5th European Thermal-Sciences Conference, The Netherlands (2008).

The matrix doped with the additional component has a higher absorption for heat radiation than would be the case in the absence of the additional component. This results in an increased fraction of energy transmission through radiation from the printed conductor into the heating element, more rapid distribution of the heat, and a higher rate of emission towards the printing substrate. By this configuration, it is feasible to provide higher radiation power per unit area and to generate a homogeneous emission and a uniform temperature field even for thin heating element walls and/or at a comparably low printed conductor occupation density.

The additional component is preferably present in the heating element material, at least in part, as elemental silicon and is embedded in an amount that effects, in the heating element material for wavelengths between 2 and 8 μm, an emissivity ε of at least 0.7 at a temperature of 600° C. and an emissivity ε of at least 0.8 at a temperature of 1,000° C.

The semiconductor material, and specifically the elemental silicon used preferably, makes the vitreous matrix material black at room temperature, but also at elevated temperature above, for example, 600° C. As a result, good emission characteristics in terms of a high broadband emission at high temperatures are attained. In this context, the semiconductor material forms an elemental semiconductor phase that is dispersed in the matrix. This phase can contain multiple semiconductor elements or metals (but metals only up to 50% by weight, and preferably no more than 20% by weight, relative to the weight fraction of the additional component).

The heat absorption of the heating element material depends on the fraction of the additional component. In the case of silicon, the weight fraction should preferably be at least 0.1%. On the other hand, a silicon fraction can have an adverse effect on the chemical and mechanical properties of the quartz glass matrix. Taking this into consideration, the weight fraction of the additional component, being silicon, is preferably in the range between 0.1 and 5%.

In a preferred embodiment of the printing machine according to the invention, the dryer unit comprises a multitude of heating elements that are arranged one behind the other in the transport direction of the printing substrate.

In this context, each dryer unit has a printer assembly assigned to it. A larger number of printer assemblies facilitates a high printing rate and high printing quality.

It has proven to be advantageous, especially in this embodiment of the printing machine, to provide a device for supplying process air into the intervening space between the printing substrate and the heating elements.

The process air is used for drying the printing substrate and for removal of the solvent from the printing ink, for example water. In order to have the printing substrate dry evenly and steadily over time across the web width of the printing substrate, it is desirable for the flow of the process air to be laminar and as reproducible as possible. A contribution to this goal is made in the printing machine according to the invention by the heating surface of the heating elements being planar, preferably being planar, and by the gap between the heating surfaces and the printing substrate being narrow.

The printing machine according to the invention can be used for rotary printing, offset printing, planographic printing, letterpress printing, screen printing or gravure printing. However, it has been particularly time-proven for the printer assembly to comprise an inkjet print head, whereby at least one draw roller fitted with a drive motor is arranged downstream from the dryer unit as seen in the transport direction of the printing substrate.

The image-generating device in the inkjet printing procedure is designed as an inkjet print head comprising one or more nozzles by which droplets of ink are transferred to the printing substrate. Specifically if water-based ink is used, the printing substrate may become deformed, for example forming ripples, which may lead to poor printing quality, damage to the print head and printing substrate, and uneven drying of the printing substrate. The latter is noticeable, in particular, if the distance between the printing substrate and the dryer unit is very small—which can be set in the printing machine according to the invention. To counteract this effect and to provide for the most even and reproducible planarity of the printing substrate possible, at least one draw roller fitted with its own drive motor is arranged downstream from the dryer unit as seen in the transport direction of the printing substrate.

If the draw roller is concurrently designed as a cooling roller, the printing substrate can be cooled right after the dryer unit, which may be helpful in minimizing any damage to the printing substrate, considering especially the potentially high input of energy.

It is to be understood that both the foregoing general description and the following detailed description are exemplary, but are not restrictive, of the disclosure.

BRIEF DESCRIPTION OF THE DRAWING

In the following, the invention is illustrated in more detail based on an exemplary embodiment and a patent drawing. In the drawing are the following figures.

DETAILED DESCRIPTION OF THE INVENTION

Figure 1:
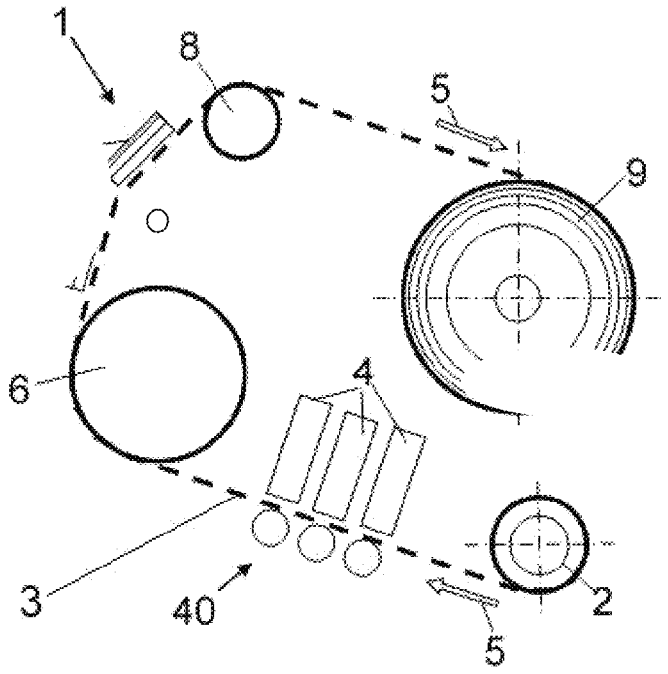
FIG. 1 shows a schematic depiction of a detail of a printing machine according to the invention with the transport path for the printing substrate through a printer assembly and an infrared dryer unit.

Referring now to the drawing, in which like reference numbers refer to like elements throughout the various figures that comprise the drawing, FIG. 1 shows a schematic depiction of an embodiment of a printing machine according to the invention in the form of a roller inkjet printing machine, which, in toto, has reference number 1 assigned to it. Starting from an unwinder 2, a material web 3 made of a printing substrate, such as, for example, paper, advances to a printer assembly 40. The printer assembly 40 comprises multiple inkjet print heads 4 arranged one after the other along the material web 3 by which solvent-containing, and, in particular, water-containing printing inks are applied onto the printing substrate.

Viewed in the transport direction 5, the material web 3 advances from the printer assembly 40 via a deflecting roller 6 to an infrared dryer unit 70. The latter is configured to have multiple infrared heating elements 7 that are designed for drying and/or sweeping away the solvent in the material web 3.

The further transport path of the material web 3 is via a draw roller 8, which is fitted with its own draw drive motor and is used for setting the web tension, to a winding roller 9.

Several heating elements 7—eight of them in the exemplary embodiment shown—are combined into a heating block that extends over the maximum format width of the printing machine 1. The individual heating elements 7 in the heating block are placed against each other without clearance, and can be controlled separately from each other in accordance with the dimensions and ink coverage of the printing substrate. An electrical and thermal insulator is situated between the individual heating elements 7. The free distance between the heating surface of the heating elements 7 and the top side of the material web 3 is 10 mm.

The transport speed of the material web 3 is set to 5 m/s. This is a comparably high speed that is made possible through an optimization of the individual processing steps and requires, in particular, a high drying rate. The dryer unit 70 required for meeting that requirement is explained in more detail in the following based on FIGS. 2 to 5.

Insofar as the same reference numbers as in FIG. 1 are used in other figures, these denote components and parts that are identical in design or equivalent as illustrated in more detail above by the description of the printing machine 1 according to the invention.

Heating Element

Figure 2:
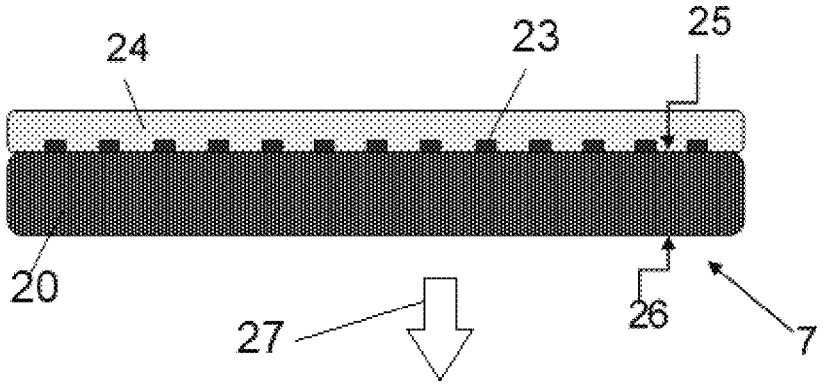
FIG. 2 shows a schematic depiction and a side view of an embodiment of the heating element according to the invention with a reflector layer.

The embodiment of the heating element 7 shown schematically in FIG. 2 is an infrared radiator with a tile-shaped base body 20 with a planar emission surface (bottom side 26) and an also planar top side 25. A printed conductor 23, which in turn is embedded in a reflector layer 24, is applied onto the top side 25 of the base body 20.

The base body 20 has a rectangular shape with a plate thickness of 2.0 mm and lateral dimensions of 10 cm×20 cm. It consists of a composite material with a matrix made of quartz glass, in which phase areas of elemental silicon are homogeneously distributed. The weight fraction of the Si phase is 2.5% and the maximum mean dimensions of the Si phase areas (median) are in the range of approximately 1 to 10 μm. The composite material is gas-tight, it has a density of 2.19 g/cm$^3$, and it is stable in air up to a temperature of approximately 1,200° C. It shows high absorption of heat radiation and high emissivity at high temperature.

The printed conductor 23 is generated from a platinum resistor paste on the top side 25 of the base body 20. Both ends have cables or clamps for the supply of electrical energy welded to them. The printed conductor 23 shows a meandering profile that covers a heating surface of the base body 20 so tightly that an even distance of 2 mm remains between neighboring sections of the printed conductor 23. In the cross-section shown, the printed conductor 23 has a rectangular profile with a width of 1 mm and a thickness of 20 μm. Due to the low thickness, the fraction of material accounted for by the expensive printed conductor material (platinum) in the infrared radiator is low compared to the efficiency thereof. The printed conductor 23 is in direct contact with the top side 25 of the base body 20 such that maximally possible heat transmission into the base body 20 is attained. The opposite bottom side 26 serves for the use of the infrared radiator as an emission surface for the heat radiation. The direction of emission is indicated by direction arrow 27.

The reflector layer 24 consists of opaque quartz glass and has a mean layer thickness between 1.0-1.5 mm. It is characterized by the absence of cracks and a high density of approximately 2.15 g/cm$^3$ and it is thermally stable up to temperatures above 1,100° C. The reflector layer 24 covers the entire heating area of the base body 20 and it covers the printed conductor 23 completely and thus shields it from ambient chemical or mechanical influences.

Measurement of the Start-Up Behavior

Figure 3:
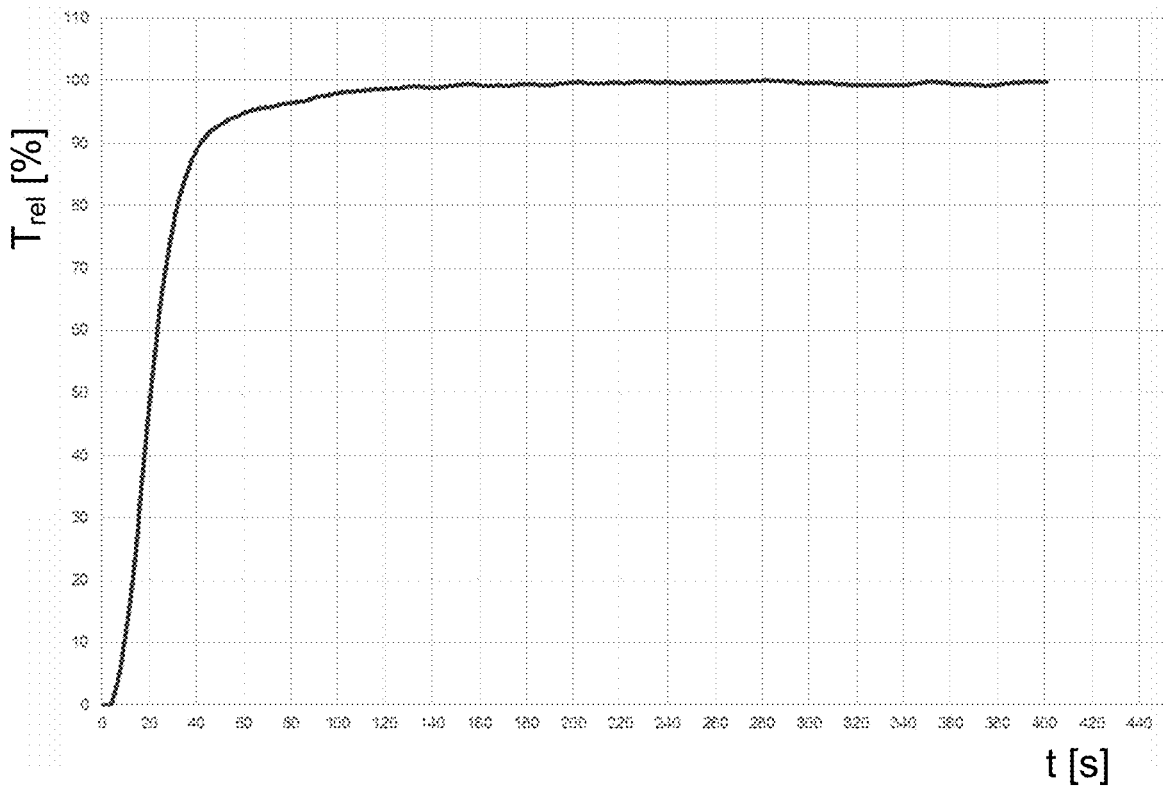
FIG. 3 shows a diagram of the start-up behavior of a heating element of the dryer unit.

The dryer unit 70 having a rapid reaction time after the printing machine 1 is switched on is a requirement for low paper wastage during the printing process. The diagram of FIG. 3 shows the temperature profile over time after the heating element 7 described based on FIG. 2 is switched on. A temperature $T_{ref}$ (in %), standardized to a maximum temperature that is reached in operation with maximum electrical connected load, is plotted on the Y axis against the switch-on time t in seconds plotted on the X axis. In this context, $T_{ref}$ is measured at a distance of 5 mm from the heating surface using a thermopile measuring sensor.

Upon the application of the maximum electrical connected load of up to 200 kW/m$^2$ to the printed conductor 23, the maximum temperature is reached after a short time as compared to conventional medium-wave infrared radiators and stays essentially constant during the further heating process. The reaction time being short as compared to conventional medium-wave infrared radiators reduces the paper wastage. Moreover, the printing machine 1 according to the invention does not require the implementation of an air cooling for the heating elements 7. This increases the process efficiency, because cold cooling air reduces the temperature of the printing substrate and impedes the dissipation of humidity. The combination of heating elements 7 without cooling and warm convective process air for humidity transport optimizes the printing process in modern high-performance printing machines.

Measurement of the Emissivity

The composite material shows high absorption of heat radiation and high emissivity at high temperature. At room temperature, the emissivity of the composite material is measured using an integrating sphere. This can be used to measure the spectral hemispherical reflectance $R_{gh}$ and the spectral hemispherical transmittance $T_{gh}$ from which the normal emissivity can be calculated. The emissivity at elevated temperature is measured in the wavelength range from 2 to 18 μm by an FTIR spectrometer (Bruker IFS 66vFTIR) to which a BBC sample chamber is coupled using an additional optical system, applying the above-mentioned BBC measuring principle. In this context, the sample chamber is provided with thermostatic black body environments in the hemispheres in front of and behind the sample holder, and with a beam exit opening with a detector. The measuring samples with a thickness of 2 mm are heated to a predetermined temperature in a separate furnace and, for the measurement, are transferred into the beam path of the sample chamber with the black body environments set to the predetermined temperature. The intensity detected by the detector is composed of emission, reflection, and transmission portions, namely intensity emitted by the sample itself, intensity that is incident on the sample from the front hemisphere and is reflected by the sample, and intensity that is incident on the sample from the back hemisphere and is transmitted by the sample. Three measurements need to be performed to determine the individual parameters, i.e., the degrees of emission, reflection, and transmission.

The degree of emission measured on the composite material in the wavelength range from 2 to approximately 4 μm is a function of the temperature. The higher the temperature, the higher is the emission. At 600° C., the normal degree of emission in the wavelength range from 2 to 4 μm is above 0.7. At 1,000° C., the normal degree of emission in the entire wavelength range between 2 and 8 μm is above 0.8.

Figure 4:
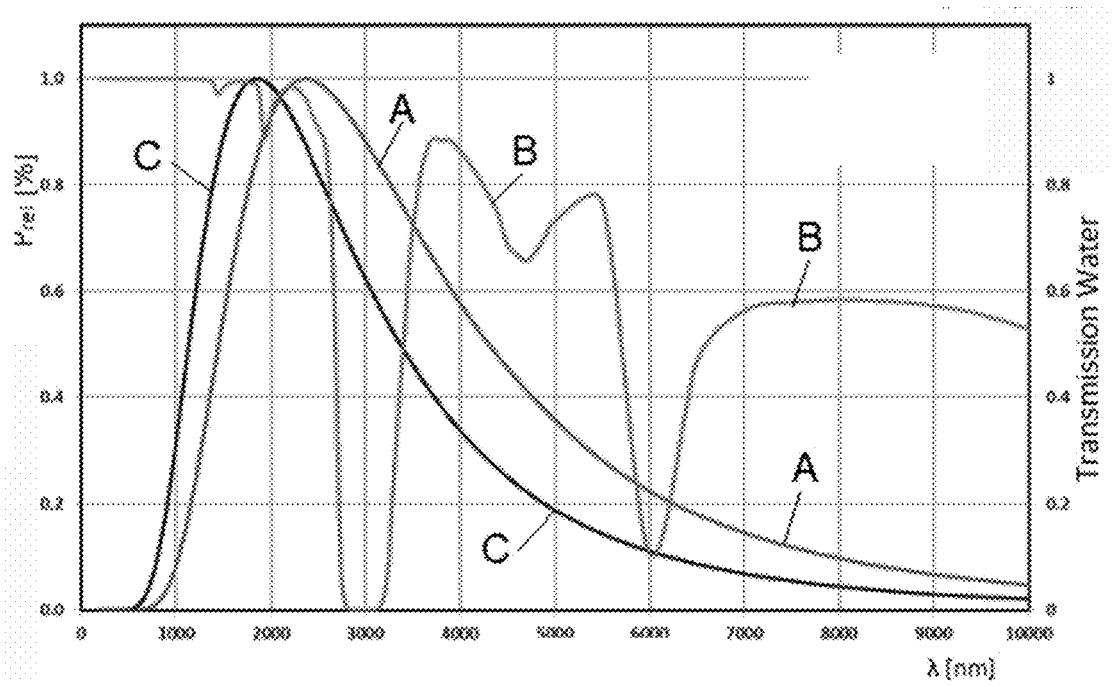
FIG. 4 shows a diagram of emission spectra of a tile-shaped heating element compared to a conventional infrared radiator with a quartz glass cladding tube and Kanthal® coil.

FIG. 4 shows the emission spectrum of the heating element 7 (curve A) as compared to the emission spectrum of a conventional infrared radiator with a quartz glass cladding tube and heating coil made of Kanthal® (curve B) at identical power. The emitted power $P_{rel}$ (value in % relative to the maximum value) is plotted on the left Y axis and the wavelength λ (in nm) is plotted on the X axis. In addition, the transmission spectrum of water is included in the diagram (curve C), whereby a relative parameter $T_{H2O}$ is plotted on the right Y axis.

The temperature of the printed conductor 23 on the base body 20 is adjusted to 1,000° C. The reference radiator possessing a Kanthal® coil is also operated at a temperature of approximately 1,000° C. It is evident that the tile-shaped heating element 7 possesses an emission peak in the wavelength range from 1,500 nm to approximately 2,000 nm that matches the transmission peak of water at 2,750 nm better than the emission profile of the standard radiator. At identical electrical power and identical distance, this results in an approximately 25% higher power density on the printing substrate as compared to the standard infrared radiator.

Measurement of the Spatial Homogeneity of the Emitted Radiation

The spatial homogeneity of the emitted radiation is tested in accordance with IEC 62798 (2014). For this purpose, the infrared panel radiator is installed in a testing device and mounted on a movable table. The optical power is detected by a thermoelectric detector at a predetermined working distance of 10 mm from the emission surface of the infrared radiator. The irradiation intensity is determined at several measuring sites at steps of 5 mm. The radiation intensity is defined to be sufficiently homogeneous if it varies by no more than +/−5% from the measured maximum value at 10 measuring sites near the middle of the sample. This type of measurement is referred to as an "axial measurement" hereinafter.

Figure 5:
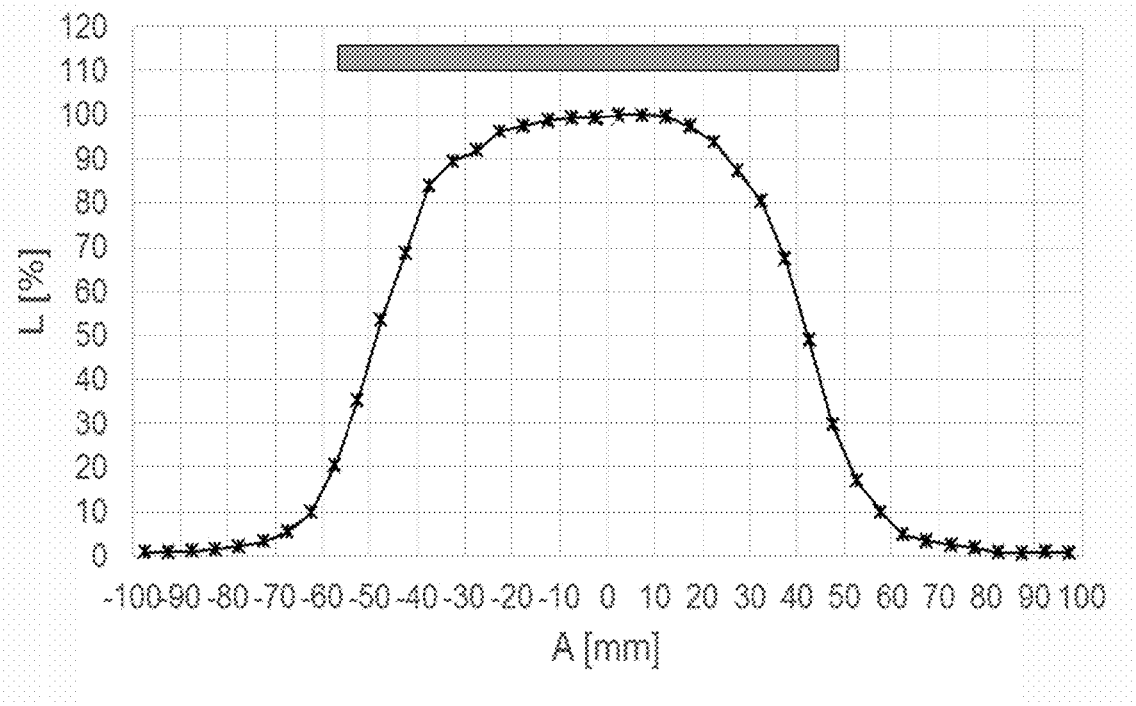
FIG. 5 shows a diagram illustrating the irradiation profile of the infrared radiation that is incident on the printing substrate during the use of the printing machine according to the invention.

The diagram of FIG. 5 illustrates the result of axial measurements using the tile-shaped heating element 7. A standardized optical power L (in %) is plotted on the Y axis, and the lateral distance A (in mm) from a center line that extends through the origin of the axes and relates to the lateral dimension of the heating element 7 is plotted on the X axis.

The lateral profile of the optical power is measured at a working distance of 10 mm. The lateral profile is comparably homogeneous at near 100% over an extended area about the center line. This is evident because the optical power does not drop below 95% of the maximum value (100%) in a working area with more than 10 measuring points about the center line.

Figure 6:
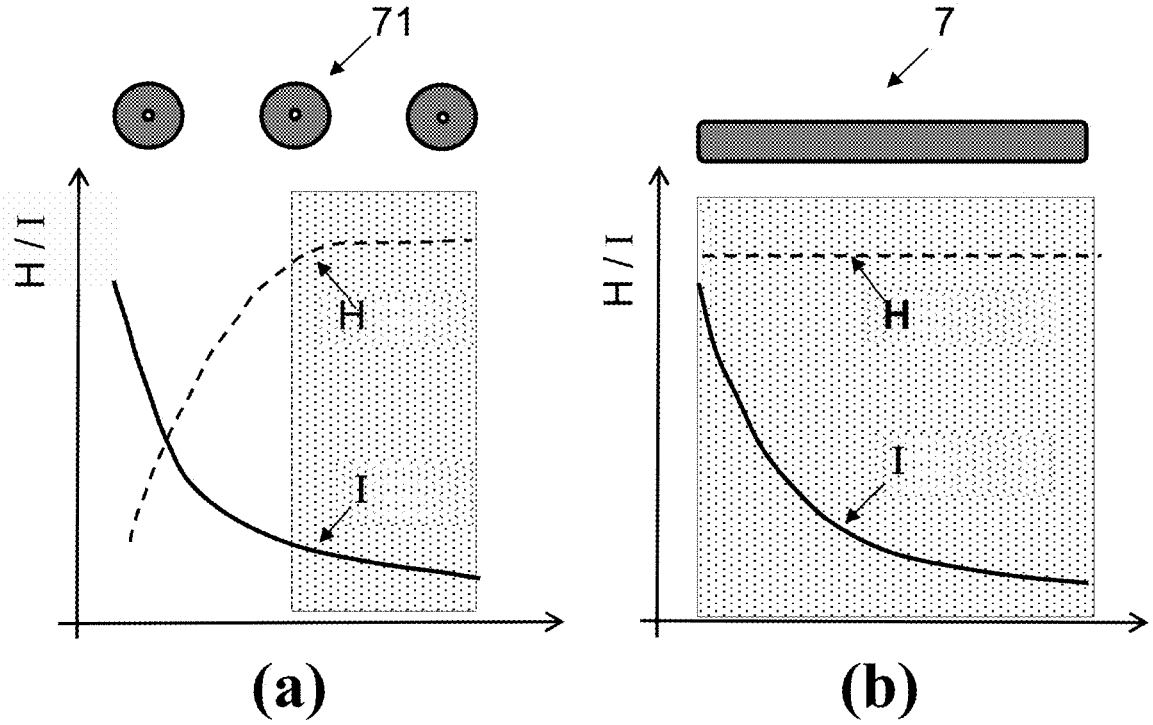
FIG. 6 shows, by way of two diagrams (a) and (b), a comparison of the homogeneity and intensity of the irradiation of a printing substrate by a tile-shaped heating element versus an infrared panel-type radiator according to the prior art.

Diagrams (a) and (b) of FIG. 6 illustrate, schematically, the relationship between the homogeneity and/or the intensity of irradiation and the distance between the radiator and the printing substrate as well as pertinent differences between an infrared panel radiator composed of several individual radiators (diagram (a)) and the tile-shaped heating element 7 for use in the printing machine 1 according to the invention (diagram (b)). The homogeneity "H" and the radiation intensity "I" incident on the heating goods are plotted, respectively, in relative units, on the ordinate of diagrams (a) and (b) over the distance "A" (also in relative units) between the radiator and the printing substrate. The panel radiator 71 in diagram (a) is represented by multiple medium- or short-wave radiant heaters that are arranged next to each other and whose cladding tubes are indicated by three circles. The tile-shaped heating element 7 of the printing machine 1 according to the invention is indicated in diagram (b). The tile-shaped heating element 7 and the planar arrangement of the carbon radiators forming the panel radiator 71 have the same electrical connected load in this context.

The profile of the homogeneity H over distance A is indicated by the dashed curve H and the profile of the intensity I is indicated by the continuous curve I. Accordingly, the irradiation intensity I decreases with the distance A approximately to the same degree in the standard panel radiator 71 and in the tile-shaped heating element 7, but the homogeneity of the irradiation is largely independent of the distance A in the case of the heating element 7, whereas it is low, at short distance, in the standard infrared panel radiator 71.

The grey-hatched area schematically defines a "working area," in which an acceptable irradiation homogeneity on the printing substrate is evident. It is evident then that this homogeneity can be attained in the standard infrared panel radiator 71 by maintaining a certain distance, but that this is associated with a significant loss of irradiation intensity. In contrast, the tile-shaped heating element 7 facilitates sufficiently high homogeneity even at very short distances, at which the intensity of the radiation is high as well. Accordingly, the heating element 7 has a significantly improved efficiency as compared to the panel radiator 71 made of individual carbon radiators.

Although illustrated and described above with reference to certain specific embodiments and examples, the present disclosure is nevertheless not intended to be limited to the details shown. Rather, various modifications may be made in the details within the scope and range of equivalents of the claims and without departing from the spirit of the disclosure. It is expressly intended, for example, that all ranges broadly recited in this document include within their scope all narrower ranges which fall within the broader ranges.

The invention claimed is:

1. A printing machine comprising:

a printer assembly adapted to apply a solvent-containing printing ink onto a printing substrate;

a dryer unit having at least one infrared radiator for drying the printing substrate, wherein the infrared radiator is a planar heating element made of a dielectric, emits infrared radiation when heated, and has a heating surface that faces the printing substrate to be dried and a contacting surface onto which a printed conductor of a heating conductor made of an electrically conductive precious metal-containing resistor material is applied that is adapted to be connected to an adjustable current source by an electrical contact; and a transport device for transporting the printing substrate front the printer assembly to the dryer unit in a transport direction, the transport device defining a maximum format width for transporting the printing substrate, wherein the heating element irradiates across the entire format width and includes multiple heating element portions that can be electrically controlled independent of each other.

2. The printing machine according to claim 1, wherein the heating element is plate-shaped and has a plate thickness of less than 10 mm.

3. The printing machine according to claim 1, wherein the heating element includes an amorphous matrix component and an additional component in the form of a semiconductor material.

4. The printing machine according to claim 1, further comprising at least one draw roller fitted with a drive motor arranged downstream from the dryer unit as seen in the transport direction of the printing substrate and wherein the printer assembly includes an inkjet print head.

5. The printing machine according to claim 4, wherein the at least one draw roller is a cooling roller.

6. The printing machine according to claim 1, wherein the heating element attains a power density in excess of 180 $kW/m^2$.

7. The printing machine according to claim 6, wherein the heating element attains a power density in the range of between 180 $kW/m^2$ to 265 $kW/m^2$.

8. A printing machine comprising:

a printer assembly adapted to apply a solvent-containing printing ink onto a printing substrate;

a dryer unit having at least one infrared radiator for drying the printing substrate, wherein the infrared radiator is a planar heating element made of a dielectric, emits infrared radiation when heated, and has a heating surface that faces the printing substrate to be dried and a contacting surface onto which a printed conductor of a heating conductor made of an electrically conductive precious metal-containing resistor material is applied that is adapted to be connected to an adjustable current source by an electrical contact;

a transport device for transporting the printing substrate from the printer assembly to the diver unit in a transport direction, wherein the dryer unit has a plurality of heating elements that are arranged one behind the other in the transport direction of the printing substrate and that define an intervening space between the printing substrate and the heating elements; and a device for supplying process air into the intervening space between the printing substrate and the heating elements.

9. A printing machine comprising:

a printer assembly adapted to apply a solvent-containing printing ink onto a printing substrate;

a dryer unit having at least one infrared radiator for dying the printing substrate, wherein the infrared radiator is a planar dielectric heating element with a plate thickness of less than 10 mm formed of an amorphous matrix component and a semiconductor material, emits infrared radiation when heated, and has a heating surface that faces the printing substrate to be dried and a contacting surface onto which a printed conductor of a heating conductor made of an electrically conductive precious metal-containing resistor material is applied that is adapted to be connected to an adjustable current source by an electrical contact; and a transport device for transporting the printing substrate from the printer assembly to the dryer unit in a transport direction, the transport device defining a maximum format width for transporting the printing substrate, wherein the heating element irradiates across the entire format width and includes multiple heating element portions that can be electrically controlled independent of each other.

10. The printing machine according to claim 9, further comprising at least one draw roller fitted with a drive motor arranged downstream from the dryer unit as seen in the transport direction of the printing substrate.

11. The printing machine according to claim 10, wherein the at least one draw roller is a cooling roller.

12. The printing machine according to claim 9, wherein the printer assembly includes an inkjet print head.

13. The printing machine according to claim 9, wherein the heating element attains a power density in excess of 180 $kW/m^2$.

14. The printing machine according to claim 13, wherein the heating element attains a power density in the range of between 180 $kW/m^2$ to 265 $kW/m^2$.

15. A printing machine comprising:

a printer assembly adapted to apply a solvent-containing printing ink onto a printing substrate;

a dryer unit having at least one infrared radiator for drying the printing substrate, wherein the infrared radiator is a planar dielectric heating element with a plate thickness of less than 10 mm formed of an amorphous matrix component and a semiconductor material, emits infrared radiation when heated, and has a heating surface that faces the printing substrate to be dried and a contacting surface onto which a printed conductor of a heating conductor made of an electrically conductive precious metal-containing resistor material is applied that is adapted to be connected to an adjustable current source by an electrical contact;

a transport device for transporting the printing substrate from the printer assembly to the dryer unit in a transport direction, wherein the dryer unit has a plurality of heating elements that are arranged one behind the other in the transport direction of the printing substrate and that define an intervening space between the printing substrate and the heating elements; and a device for supplying process air into the intervening space between the printing substrate and the heating elements.

16. A printing machine comprising:

a printer assembly including an inkjet print head and being adapted to apply a solvent-containing printing ink onto a printing substrate;

a dryer unit having at least one infrared radiator for drying the printing substrate, wherein the infrared radiator (a) is a planar dielectric heating element that attains a power density in excess of 180 $kW/m^2$ with a plate thickness of less than 10 nm formed of an amorphous matrix component and a semiconductor material and with multiple heating element portions that can be electrically controlled independent of each other and that define an intervening space between the printing substrate and the heating element, (b) emits infrared radiation when heated, and (c) has a heating surface that faces the printing substrate to be died and a contacting surface onto which a printed conductor of a heating conductor made of an electrically conductive precious metal-containing resistor material is applied that is adapted to be connected to an adjustable current source by an electrical contact;

a device for supplying process air into the intervening space between the printing substrate and the heating element;

a transport device for transporting the printing substrate from the printer assembly to the dryer unit in a transport direction, the transport device defining a maximum format and the heating element irradiating across the entire format width; and at least one draw roller fitted with a drive motor arranged downstream from the dryer unit as seen in the transport direction of the printing substrate.

* * * * *